US007270565B2

(12) United States Patent
Kamata et al.

(10) Patent No.: US 7,270,565 B2
(45) Date of Patent: Sep. 18, 2007

(54) CONNECTOR HOUSING, CONNECTOR HOUSING MARKING METHOD, AND METHOD OF INSERTING TERMINAL METAL FITTING INTO CONNECTOR HOUSING

(75) Inventors: Takeshi Kamata, Shizuoka (JP); Kiyoshi Yagi, Shizuoka (JP); Shigeharu Suzuki, Shizuoka (JP); Keigo Sugimura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/533,537

(22) PCT Filed: Nov. 5, 2003

(86) PCT No.: PCT/JP03/14086

§ 371 (c)(1),
(2), (4) Date: Dec. 6, 2005

(87) PCT Pub. No.: WO2004/042878

PCT Pub. Date: May 21, 2004

(65) Prior Publication Data

US 2006/0105618 A1 May 18, 2006

(30) Foreign Application Priority Data

Nov. 5, 2002 (JP) ..... 2002-320756

(51) Int. Cl.
*H01R 3/00* (2006.01)

(52) U.S. Cl. ..... 439/491

(58) Field of Classification Search ..... 439/491; 347/101

See application file for complete search history.

(56) References Cited

U.S. PATENT DOCUMENTS 3,989,338 A * 11/1976 Gosser ..... 439/491

(Continued)

FOREIGN PATENT DOCUMENTS

| | | |
|---|---|---|
| JP | 4-55770 | 5/1992 |
| JP | 5-92976 | 12/1993 |

(Continued)

*Primary Examiner*—Briggitte R. Hammond
(74) *Attorney, Agent, or Firm*—Kratz, Quintos & Hanson, LLP

(57) ABSTRACT

An object of this invention is to provide a connector housing which can be prevented a terminal-receiving chamber from receiving a wrong metal terminal.

A connector housing 1 comprises a plurality of terminal-receiving chambers 20 and a plurality of marks 21. The terminal-receiving chamber 20 receives a male terminal 3. Electric wire 2 is attached to the male terminal 3. A mark 6 is formed on an outer surface 5*a* of the electric wire 2. A color of the mark 6 of one electric wire 2 is a first color R. A color of the mark 6 of the other electric wire 2 is a second color G. The first color R is different from the second color G. The mark 21 corresponds to each terminal-receiving chamber 20. A color of one mark 21 is the first color R, which is the same as the color of the mark 6 of the one electric wire 2. A color of the other mark 21 is the second color G, which is the same as the color of the mark 6 of the other electric wire 2. By forming the mark 21 in a same color as the mark 6 of the electric wire 2 attached to the male terminal 3 which is to be inserted into the terminal-receiving chamber 20 corresponding to the mark 21, the mark 21 indicates the male terminal 3 to be received by the terminal-receiving chamber 20 corresponding to the mark 21.

3 Claims, 6 Drawing Sheets

U.S. PATENT DOCUMENTS

| | | | | |
|---|---|---|---|---|
| 4,820,193 | A * | 4/1989 | Noorily | 439/488 |
| 5,162,818 | A * | 11/1992 | Karita et al. | 439/488 |
| 5,211,583 | A * | 5/1993 | Endo et al. | 439/491 |
| 2005/0285919 | A1* | 12/2005 | Martinez et al. | 347/101 |

FOREIGN PATENT DOCUMENTS

| | | |
|---|---|---|
| JP | 7-24371 | 1/1995 |
| JP | 2000-348807 | 12/2000 |

* cited by examiner

CONNECTOR HOUSING, CONNECTOR HOUSING MARKING METHOD, AND METHOD OF INSERTING TERMINAL METAL FITTING INTO CONNECTOR HOUSING

TECHNICAL FIELD

This invention relates to an electric connector housing, a method for marking the electric connector housing and a method for inserting a metal terminal into the electric connector housing.

BACKGROUND ART

A various electrical components are mounted on a mobile body such as a vehicle. Accordingly, a wire harness is arranged to communicate electric power from a battery, a control signal from a computer, and the like to the electrical components in the vehicle. The wire harness includes a plurality of electric wire and an electric connector attached to ends of the electric wire.

The electric wire includes conductive core wire and a sheath made of insulating synthetic resin for coating the core wire. The electric wire is what is called coated electric wire. The electric wire is made by extruding insulating synthetic resin around the core wire. When carrying out the extrusion coating, coloring agent for a desired color is mixed with the synthetic resin to color the electric wire in the desired color.

The electric connector includes a conductive metal terminal and an insulating connector housing 100 as shown in FIG. 7. The metal terminal is attached to such as an end of the electric wire and connected to the core wire of the electric wire electrically. The insulating connector housing 100 is formed in a box shape, and includes a plurality of terminal-receiving chambers 101 for receiving the metal terminal.

For assembling the wire harness, firstly the metal terminal is attached to an end of the electric wire, which is previously cut to a specified length. If required, some piece of wire may be connected to the same metal terminal. Then, the metal terminal is inserted into the terminal-receiving chamber 101 of the insulating connector housing 100. Thus, the wire harness is assembled. The electric connector of the wire harness is connected to a mating connector of the electrical component, while the wire harness is routed through a vehicle and the like. The wire harness supplies specified signals or electric power to the electrical components.

When assembling the wire harness, it is necessary that the specified metal terminal be inserted into the specified terminal-receiving chamber 101. On the other hand, outer surfaces of the electric wire of the wire harness are colored in various colors for identifying a size of core wire, coating material having different characteristics such as thermostability, intended purpose; or the like. Each electric wire is distinguished from each other by changing the color of the outer surface.

Therefore, conventionally, various assembling tools (one example is shown in FIG. 7) are used for inserting the specified metal terminal into the specified mating terminal-receiving chamber 101, as disclosed, for example, in Japanese Utility Model Application Laid-Open No. Hei 5-92976. An assembling tool 102 as shown in FIG. 7 includes a plate-shaped tool body 103 and a plurality of marks 104. The tool body 103 is detachable from the connector housing 100.

Each mark 104 is formed on a surface of the tool body 103. Each mark 104 corresponds to each terminal-receiving chamber 101 of the connector housing 100. By attaching the tool body 103 on the connector housing 100, each mark 104 is positioned near an opening 101a of the corresponding terminal-receiving chamber 101. The mark 104 is colored in the color of the outer surface of the specified electric wire being attached to the metal terminal which is to be received by the mating terminal-receiving chamber 101 corresponding to the mark.

For inserting the metal terminal into the terminal-receiving chamber 101 using the assembling tool 102, firstly, the tool body 103 is attached on the connector housing 100. An operator inserts the metal terminal having the electric wire with the same color as the mark 104 into the terminal-receiving chamber 101 corresponding to said mark 104 sequentially. By this means, the electric connector is assembled by inserting the metal terminal into the terminal-receiving chamber 101 of the connector housing 100.

Since the tool body 103 is detachable from the connector housing 100 in the conventional assembling tool 102, some displacement between the tool body 103 and the connector housing 100 may occur. When the tool body 103 is displaced, the mark 104 is naturally displaced so that it becomes difficult to insert the specified metal terminal into the mating terminal-receiving chamber 101.

If the metal terminal is inserted into a wrong terminal-receiving chamber 101, the metal terminal is extracted and inserted into the mating terminal-receiving chamber 101. When extracting the metal terminal from the wrong terminal-receiving chamber 101, the metal terminal may be damaged. In this case, the damaged metal terminal has to be exchanged. Further, in the conventional assembling tool 102, if the tool body 103 is removed from the connector housing 100 after inserting the metal terminal into the terminal-receiving chamber 101, it cannot be verified whether the specified metal terminal has been correctly inserted into the mating terminal-receiving chamber 101 or not.

A first object of the present invention is to provide an electronic connector housing and a method for inserting a metal terminal into the electric connector housing, which can prevent the metal terminal from being inserted into a wrong terminal-receiving chamber and allow to verify whether the specified metal terminal has been inserted into the mating terminal-receiving chamber or not after removing an assembling tool which is used for said insertion. A second object of the present invention is to provide a method for marking the electronic connector housing to obtain the electronic connector housing, which can prevent the metal terminal from being inserted into a wrong terminal-receiving chamber and allow to verify whether the specified metal terminal has been inserted into the mating terminal-receiving chamber or not after removing an assembling tool which is used for said insertion.

DISCLOSURE OF INVENTION

For achieving the first object of the invention, a connector housing comprises a plurality of terminal-receiving chambers for receiving a metal terminal, wherein a mark is provided on an outer surface of the connector housing corresponding to each terminal-receiving chamber, and indicates a specified metal terminal to be received by said mating terminal-receiving chamber.

For achieving the first object of the invention, a connector housing is the connector housing wherein the terminal-receiving chamber is formed with a plurality of partition walls, an opening of the terminal-receiving chamber is surrounded with said partition walls, and the mark is provided on a surface of one of the partition walls surrounding the opening of the terminal-receiving chamber, said surface being flush with the opening.

For achieving the first object of the invention, a connector housing is the connector housing wherein the terminal-receiving chamber is formed with a plurality of partition walls, the opening of the terminal-receiving chamber is surrounded with the plurality of partition walls, and the mark is provided on an end near the opening of an inner surface of the terminal-receiving chamber.

For achieving the second object of the invention, a method of marking a connector housing comprises the steps of: providing a connector housing with a plurality of terminal-receiving chambers for receiving a metal terminal; forming a mark corresponding to each terminal-receiving chamber for indicating a specified metal terminal to be received by the mating terminal-receiving chamber corresponding to the mark, wherein said step of forming the mark is achieved by jetting a specified volume of coloring agent toward the connector housing to deposit the coloring agent on the connector housing.

For achieving the second object of the invention, a method of marking a connector housing is the method of marking a connector housing wherein the step of providing the connector housing with a plurality of terminal-receiving chambers is achieved by forming the terminal-receiving chamber with a plurality of partition walls to surround an opening of the terminal-receiving chamber with the partition walls, and the step of forming the mark is achieved by jetting a specified volume of the coloring agent toward a surface of one of the partition walls surrounding the opening of the terminal-receiving chamber, said surface being flush with said opening.

For achieving the second object of the invention, a method of marking a connector housing is the method of marking a connector housing wherein the step of providing the connector housing with a plurality of terminal-receiving chambers is achieved by forming the terminal-receiving chamber with a plurality of partition walls to surround the opening of the terminal-receiving chamber with the partition walls, and the step of forming the mark is achieved by jetting a specified amount of the coloring agent toward an end near the opening of the inner surface of the terminal-receiving chamber.

For achieving the first object of the invention, a method of inserting a metal terminal into a connector housing having a plurality of terminal-receiving chambers for receiving a metal terminal comprises the steps of: forming the terminal-receiving chamber with a plurality of partition walls to surround an opening of the terminal-receiving chamber with the partition walls; marking a plurality of marks, each of which is provided at each terminal-receiving chamber, and indicates a specified metal terminal to be received by the mating terminal-receiving chamber corresponding to the mark; and inserting the specified metal terminal to the mating terminal-receiving chamber corresponding to the mark through the opening.

For achieving the first object of the invention, preferably, a method of inserting the metal terminal into the connector housing is the method of inserting the metal terminal into the connector housing wherein the mark is provided on a surface, which is flush with an opening of the terminal-receiving chamber, of one of the partition walls surrounding the opening.

For achieving the first object of the invention, a method of inserting the metal terminal into the connector housing is the method of inserting the metal terminal into the connector housing wherein the mark is provided at an end near the opening of the inner surface of the terminal-receiving chamber.

According to the present invention, the mark indicating the metal terminal to be received by the mating terminal-receiving chamber is provided, corresponding to each mating terminal-receiving chamber. Therefore, the metal terminal indicated by the mark can be inserted by turns into the mating terminal-receiving chamber. Further, since the mark is provided on the outer surface of the connector housing, a displacement between the mark and the connector housing can be prevented. The mark as defined in this description implies various figures, characters (including numerals) and the like.

According to the present invention, the mark is provided on the surface of one of the partition walls surrounding the opening of the terminal-receiving chamber. Therefore, the mark can be easily recognized and the displacement between the mark and the connector housing can be prevented.

According to the present invention, the mark is provided at an end near the opening of the inner surface of the terminal-receiving chamber. Therefore, the mark can be easily recognized and the displacement between the mark and the connector housing can be prevented. Further, since the mark is provided on the inner surface of the terminal-receiving chamber, a correspondence error between the mark and the terminal-receiving chamber can be prevented.

According to the present invention, a specified volume of the coloring agent is jetted toward the connector housing. Therefore, coloring agents deposited on the connector housing can be prevented from mixing together. Accordingly, the marks corresponding to respective terminal-receiving chambers can be formed reliably.

In addition, the coloring agent as defined in this description implies liquid material (industrial organic material) made by dissolving or dispersing coloring material in water or other solvents. There are pigment and dye (most of them are organic material and synthetic compounds) as organic material. Sometimes the dye is used as the pigment and the pigment is used as the dye. For a more concrete example, the coloring agent as defined in this description implies both a coloring liquid and paint.

The coloring liquid implies material made by dissolving or dispersing the dye in a solvent. The paint implies material made by dispersing the pigment in dispersion liquid. Therefore, if the outer surface of the connector housing is colored by the coloring liquid, the dye sinks into the connector housing. If the outer surface of the connector-housing is colored by the paint, the pigment does not sink into the connector housing, but adheres to the outer surface of the connector housing. Namely, coloring the outer surface of the connector housing in this description implies both dyeing partially the outer surface of the connector housing with the dye and painting partially the outer surface of the connector housing with the pigment.

Preferably, the solvent and the dispersion liquid have affinities for synthetic resin forming the connector housing. In this case, it means that the dye reliably sinks into the connector housing, and the pigment reliably adheres to the outer surface of the connector.

According to the present invention, a specified volume of coloring agent is jetted toward the surface of one of the partition walls of the connector housing. Therefore, the mark is reliably formed on the surface of one of the partition walls surrounding the terminal-receiving chamber. Accordingly, the mark can be easily recognized.

According to the present invention, a specified volume of coloring agent is jetted toward the end near the opening of the inner surface of the terminal-receiving chamber. Therefore, the mark can be reliably formed at the end near the opening of the inner surface of the terminal-receiving chamber. Accordingly, the mark can be easily recognized. Since the mark is provided on the inner surface of the terminal-receiving chamber, the correspondence error between the mark and the terminal-receiving chamber can be prevented.

According to the present invention, the mark indicating the metal terminal to be received by the mating terminal-receiving chamber is provided, corresponding to each mating terminal-receiving chamber. Further, since the mark is provided on the outer surface of the connector housing, a displacement between the mark and the connector housing can be prevented. Therefore, since the metal terminal indicated by the mark is inserted by turns into the mating terminal-receiving chamber corresponding to the mark, a metal terminal can be prevented from being inserted into a wrong terminal-receiving chamber.

According to the present invention, the mark is provided on the surface of one of the partition walls surrounding the opening of the terminal-receiving chamber. Therefore, the mark can be easily recognized and the displacement between the mark and the connector housing can be prevented. Accordingly, since the mark can be easily recognized, by inserting by turns the metal terminal indicated by the mark into the mating terminal-receiving chamber corresponding to the mark, the metal terminal can be prevented from being inserted into a wrong terminal-receiving chamber.

According to the present invention, the mark is provided at an end near the opening of the inner surface of the terminal-receiving chamber. Therefore, the mark can be easily recognized and the displacement between the mark and the connector housing can be prevented. Further, since the mark is provided on the inner surface of the terminal-receiving chamber, a correspondence error between the mark and the terminal-receiving chamber can be prevented. Accordingly, since the mark can be easily recognized and the correspondence error between the mark and the terminal-receiving chamber can be prevented, by inserting by turns the metal-terminal indicated by the mark into the mating terminal-receiving chamber corresponding to the mark, the metal terminal can be prevented from being inserted into a wrong terminal-receiving chamber.

BEST MODE FOR CARRYING OUT THE INVENTION

Figure 1:
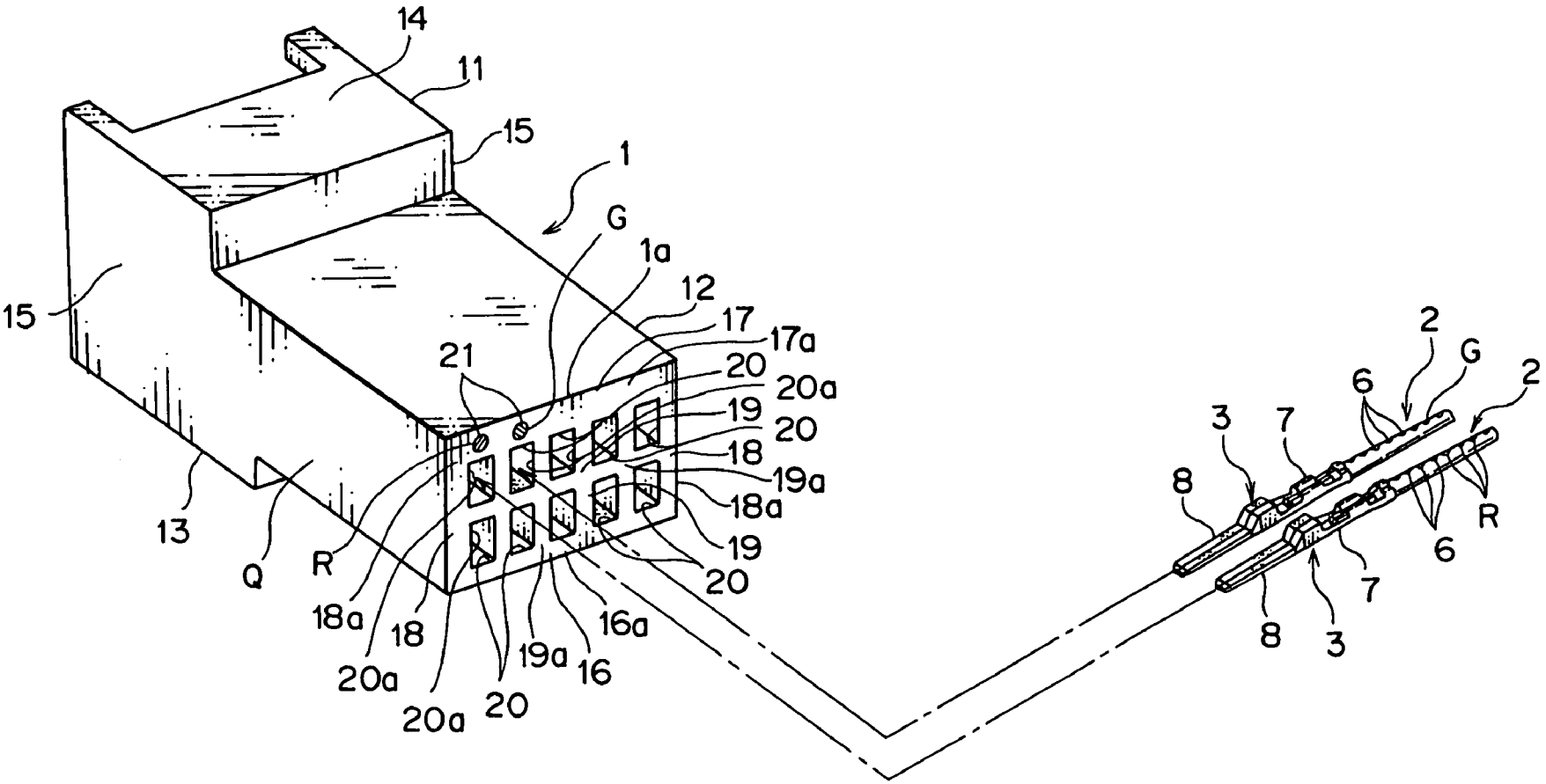
FIG. 1 is a perspective view showing a connector housing and a plurality of male terminals according to one embodiment of the present invention.

A connector housing as an embodiment of the present invention will now be described with reference to FIG. 1 to 5. A connector housing 1 as shown in FIG. 1 receives a male metal terminal 3 (hereinafter called "male terminal"), to which electric wire 2 is attached, to compose a wire harness for wiring in such as a vehicle. In addition, only two of the male terminals 3 are shown, and the rest of the male terminals 3 are omitted in FIG. 1.

Figure 3:
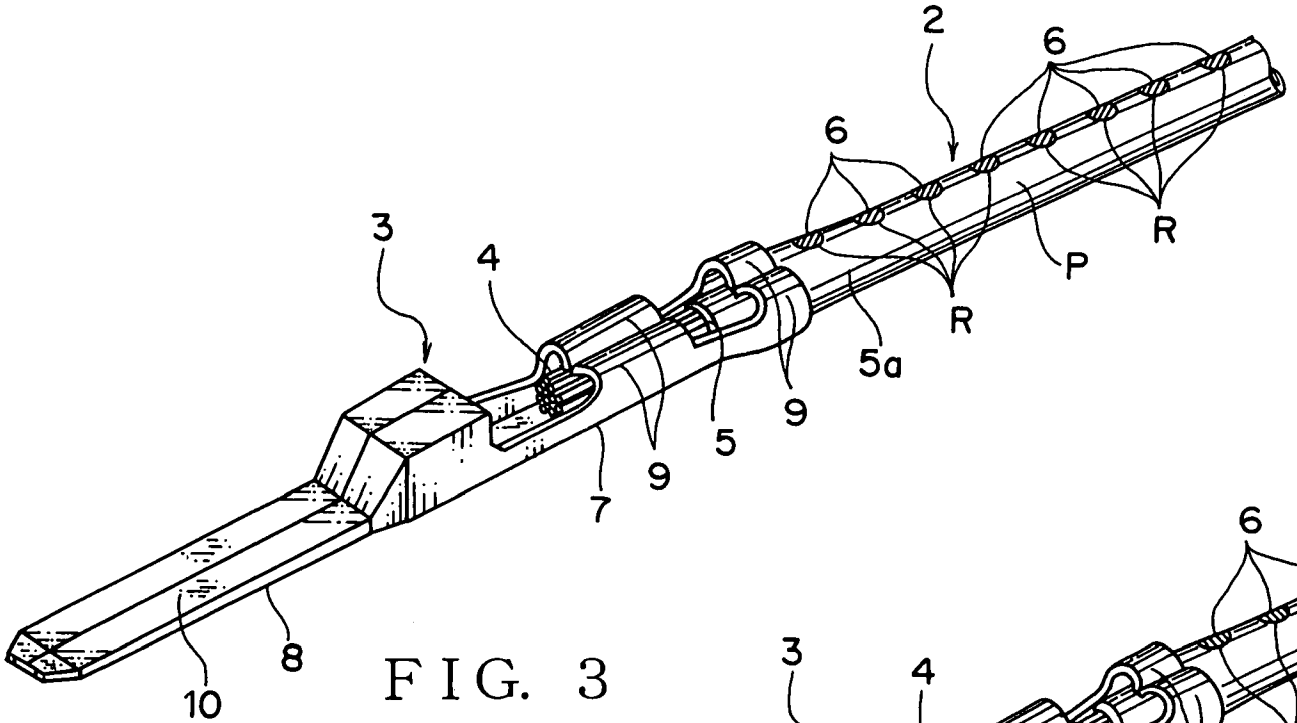
FIG. 3 is a perspective view showing one of the male terminals of FIG. 1.
Figure 4:
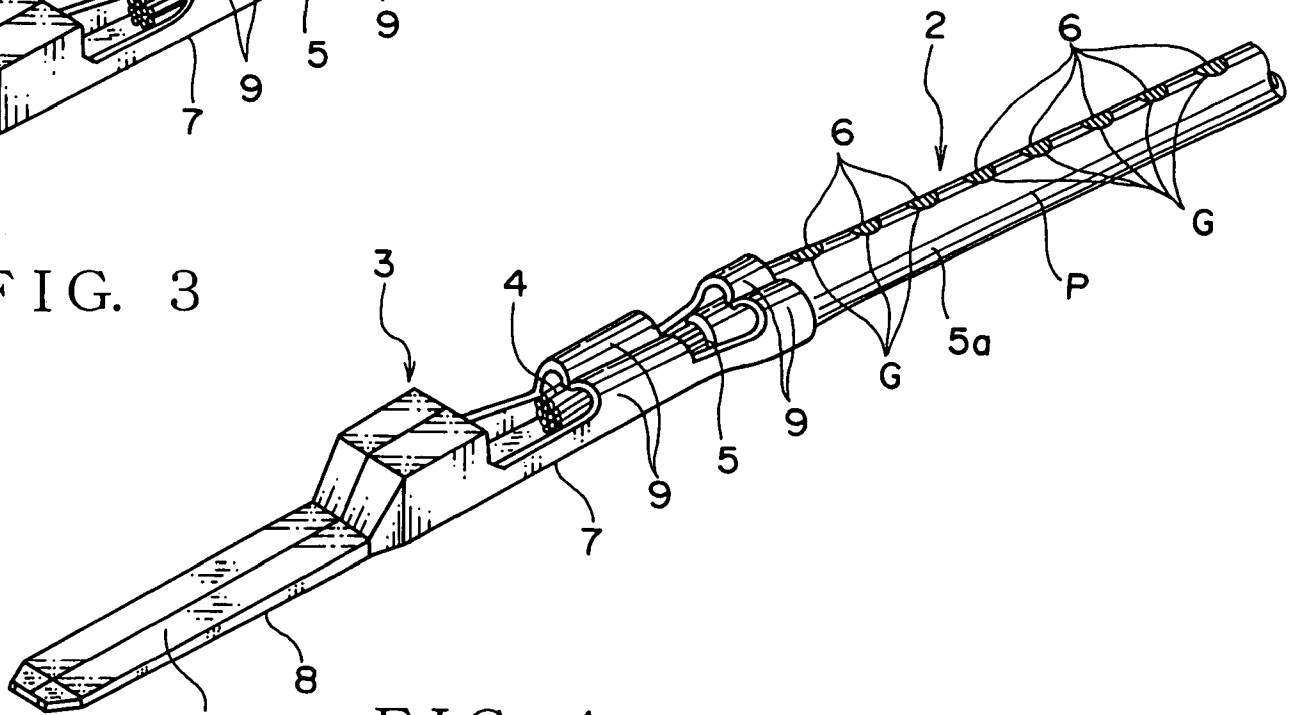
FIG. 4 is a perspective view showing the other male terminal of FIG. 1.

As shown in FIGS. 3 and 4, the electric wire 2 comprises a conductive core wire 4 and an insulating sheath part 5. The core wire 4 is made by twisting a plurality of strands. The strand composing the core wire 4 is made of conductive metal. Additionally, the core wire 4 may be composed of one strand. The sheath part 5 is made of synthetic resin such as Polyvinylchloride (PVC). Since the sheath part 5 covers the core wire 4, an outer surface 5*a* of the sheath part 5 composes an outer surface of the electric wire 2.

In addition, a color of the outer surface 5*a* of the sheath part 5 is P in monochrome (hereinafter called "monochrome"). In addition, the outer surface 5*a* may be colored in monochrome P by mixing the synthetic resin composing the sheath part 5 with a desired coloring agent, or by the synthetic resin's own color without mixing the synthetic resin composing the sheath part 5 with the coloring agent. When the monochrome P of the outer surface 5*a* is the synthetic resin's own color without mixing the synthetic resin with the coloring agent, the outer surface 5*a* of the sheath part 5, namely the electric wire 2, is called "unpigmented".

Thus, "unpigmented" implies that the color of the outer surface 5*a* of the electric wire 2 is the synthetic resin's own color without mixing the synthetic resin composing the sheath part 5 with the coloring agent. In addition, in this embodiment, the monochrome P of the outer surface 5*a* is white by mixing the synthetic resin composing the sheath part 5 with a white coloring agent.

As shown in FIGS. 3 and 4, a plurality of marks 6 is formed on a part of the outer surface 5*a* of the electric wire 2. The mark 6 is a circle in a plane. The mark 6 is a round figure. The marks 6 are arranged along a longitudinal direction of the core wire 4 and the sheath part 5, namely the electric wire 2. The marks are adjacent to and spaced from each other along the longitudinal direction of the sheath part 5, namely the electric wire 2.

In the electric wire 2 as shown in FIG. 3, the color of the mark 6 is a first color R (indicated by diagonally hatched bars in FIG. 3). Therefore, in the electric wire 2 as shown in FIG. 3, the mark 6 is made by coloring partially the outer surface 5*a* by the first color R. The first color R is different from the monochrome P.

In the electric wire 2 as shown in FIG. 4, the color of the mark 6 is a second color G (indicated by diagonally hatched bars in FIG. 4). Therefore, in the electric wire 2 as shown in FIG. 4, the mark 6 is made by coloring partially the outer surface 5*a* by the first color G. The second color G is different from both the monochrome P and the first color R.

Like a mark 21 described below of the connector housing 1, the mark 6 of the electric wire 2 as shown in FIG. 3 and 4 is formed by such as dropping a specified volume of the liquid coloring agent at a time.

In the electric wire 2 as shown in FIGS. 3 and 4, the electric wires 2 are distinguished by changing the colors R, G of the mark 6. As shown in FIG. 3 and 4, the male terminal 3 is attached to the end of the electric wire 2, then the electric wire 2 is attached to the connector housing 1. Then a plurality of the electric wire 2 are tied in a bundle to compose the wire harness described above. By such as connecting the connector housing 1 to a connector of various electric instruments of such as a vehicle, the wire harness, namely the electric wire 2, is arranged to supply the various electric instruments with various signals and electric power.

The colors R, G and the like of the mark 6 described above are used for identifying a variety of the electric wire 2 arranged in vehicle, a variety of systems of a vehicle using the electric wire 2, or the like. Namely, the colors R, G, and the like of the mark 6 indicate uses of the respective electric wires 2 and are allowed to identify the uses. Therefore, the outer surface of the electric wire 2 is marked (colored) with the liquid coloring agent for identifying the uses, namely the variety of the wire and the variety of the systems.

The male terminal 3 is made of such as sheet metal, and as shown in FIGS. 3 and 4, includes an electric wire connecting part 7 and an electric contact part 8 continued from the electric wire connecting part 7. The electric wire connecting part 7 includes a plurality of crimping parts 9 for crimping the electric wire 2. The electric wire 2 is fixed to the electric wire connecting part 7 by crimping the electric wire 2 with the crimping parts 9. Thus, the electric wire connecting part 7 is electrically connected to the core wire 4 of the electric wire 2.

The electric contact part 8 includes a blade shaped (strip shaped) tab 10. The tab 10 is inserted into an electrical contact part of a female metal terminal (hereinafter called "female terminal") as a mating metal terminal. When the tab 10 is inserted into the electrical contact part of the female terminal, the electric contact part 8 is electrically connected to the female terminal.

After the electric wire 2 is attached to the electric wire connecting part 7, the male terminal 3 having the configuration described above is received by a terminal-receiving chamber 20, which will be described later, of the connector housing 1. Then, when the connector housing 1 is connected to a mating connector housing, the tab 10 is inserted into the electric contact part of the female metal terminal received by the mating connector housing. Then, the male terminal 3 electrically connects the electric wire 2 to the female terminal.

The connector housing 1 is made of insulating synthetic resin and is formed in a box shape as shown in FIG. 1. In addition, a color of the outer surface la of the connector housing 1 is Q in monochrome (hereinafter called "monochrome"). In addition, the outer surface la may be colored in monochrome Q by mixing the synthetic resin composing the connector housing 1 with a desired coloring agent, or by the synthetic resin's own color without mixing the synthetic resin composing the connector housing 1 with the coloring agent. Namely, the outer surface 1*a* may be unpigmented.

When the monochrome Q of the outer surface 1*a* is the synthetic resin's own color without mixing the synthetic resin with the coloring agent, the outer surface 1*a* of the connector housing 1 is called "unpigmented". Thus, "unpigmented" implies that the color of the outer surface 1*a* of the connector housing 1 is the synthetic resin's own color without mixing the synthetic resin composing the connector housing 1 with the coloring agent.

The connector housing 1 includes an insertion portion 11 to which the mating connector is inserted, and a terminal-receiving portion 12 which receives the male terminal 3.

The insertion part 11 includes a bottom wall 13, a ceiling wall 14 spaced from and facing the bottom wail 13, and a pair of side walls 15 continued to the bottom wall 13 and the ceiling wall 14. The insertion part 11 is formed in a square tube shape. The pair of side walls 15 are spaced from and facing each other.

The terminal-receiving portion 12 includes a bottom wall 16, a ceiling wall 17 spaced from and facing the bottom wall 16, a pair of side walls 18 continued to the bottom wall 16 and the ceiling wall 17, and a plurality of partition walls 19. The terminal-receiving portion 12 is formed in a square tube shape. The bottom wall 16 is continued to the bottom wall 13. The ceiling wall 17 is continued to the ceiling wall 14. The side walls 18 is continued to the side walls 15.

The partition walls 19 partition a space surrounded by the bottom wall 16, the ceiling wall 17 and a pair of side walls 18 into a plurality of rooms. One partition wall 19 is continued to the bottom wall 16 and the ceiling wall 17, and parallel to the side walls 18. Other partition walls 19 are continued to both of the pair of side walls 18 and parallel to both the bottom wall 16 and the ceiling wall 17.

The space surrounded by the above-described walls 16, 17, 18, 19 composes the terminal-receiving chamber 20. Accordingly, the connector housing 1 includes a plurality of terminal-receiving chambers 20. Consequently, the terminal-receiving chamber 20 is partitioned by the plurality of walls 16, 17, 18, 19, and an opening 20*a* of the terminal-receiving chamber 20 is surrounded by the walls 16, 17, 18, 19. The terminal-receiving chamber 20 is extended in a straight line. A plurality of terminal-receiving chambers 20 are parallel to each other. The terminal-receiving chamber 20 receives the male terminal 3, to which such as the electric wire 2 is attached. Moreover, the bottom wall 16, the ceiling wall 17, the side walls 18 and the partition walls 19 compose partition walls partitioning the space into the terminal-receiving chambers 20 in this description.

Figure 2:
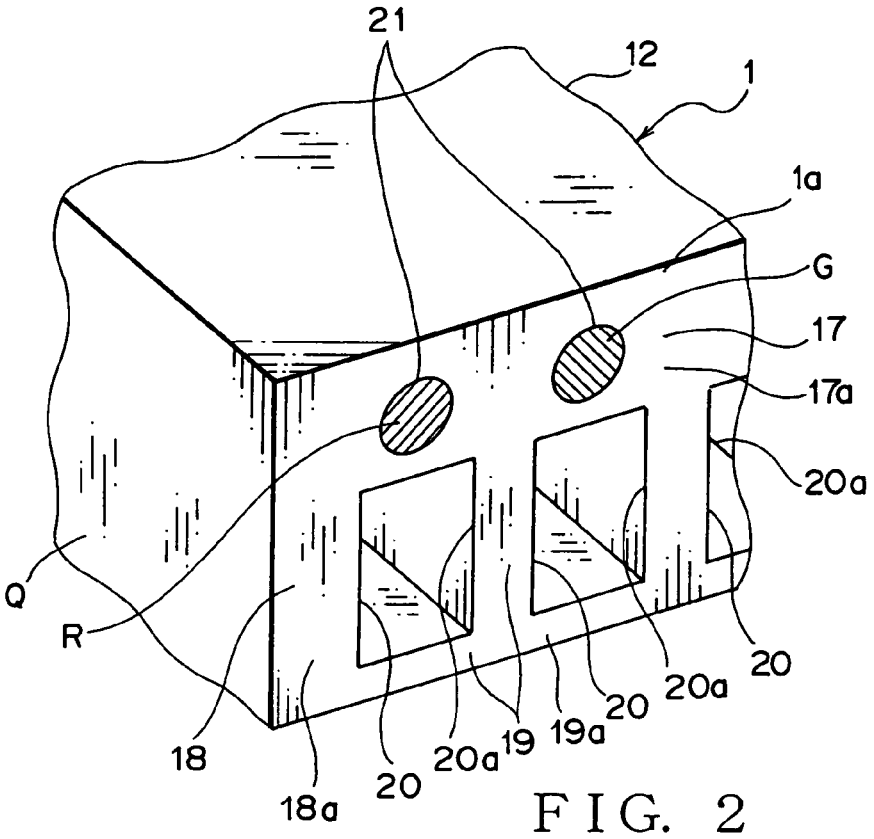
FIG. 2 is an enlarged perspective view showing a substantial part of the connector housing of FIG. 1.

Further, the connector housing 1 includes a plurality of marks 21 as shown in FIG. 2. A plane view of the mark 21 is a round shape. The mark 21 is round. The mark 21 is provided on an outer surface 1*a* of the connector housing 1, corresponding to each terminal-receiving chamber 20. In FIGS. 1 and 2, only two marks 21 are shown and the others are omitted. A color of the mark 21 is different from the monochrome Q of the outer surface 1*a* of the connector housing 1, and is the first color R or the second color G. For this purpose, the mark 21 is made by coloring a part of the outer surface 1*a* of the connector housing 1 in the first color R or the second color G.

In FIG. 2, a color of one of the marks 21 is the first color R, which is the same color as the mark 6 of the electric wire 2, said wire 2 being attached to the male terminal 3 to be received by the terminal-receiving chamber 20 corresponding to said mark 21. In FIG. 2, a color of the other mark 21 is the second color G, which is the same color as the mark 6 of the electric wire 2, said wire 2 being attached to the male terminal 3 to be received by the terminal-receiving chamber 20 corresponding to said mark 21. Thus, by coloring the marks 21 R and G which are the same color of the marks 6 of the electric wires 2 attached to the male terminals 3 to be received by the mating terminal-receiving chambers 20, said terminal-receiving chambers 20 respectively corresponding to the marks 6, the marks 21 indicate the respective male terminals 3 to be received by the mating terminal-receiving chambers 20.

Further, in this embodiment, the mark 21 is provided on a surface 17*a*, which is exposed outside the connector housing 1, of the ceiling wall 17, which is one of the partition walls surrounding the opening 20*a* of the terminal-receiving chamber 20 corresponding to said mark 21. Said surface 17*a* is flush with the opening 20*a*.

When the male terminal 3 is inserted into the connector housing 1 having the configuration described above, each male terminal having the electric wire 2, of which the mark 6 is provided on the outer surface 5*a*, is inserted by turn into the terminal-receiving chamber 20 corresponding to the mark 21 through the opening 20*a* of said terminal-receiving chamber 20. Thus, by the terminal-receiving chamber 20 receiving the male terminal 3, the male terminal 3 is attached to the connector housing 1.

Figure 5:
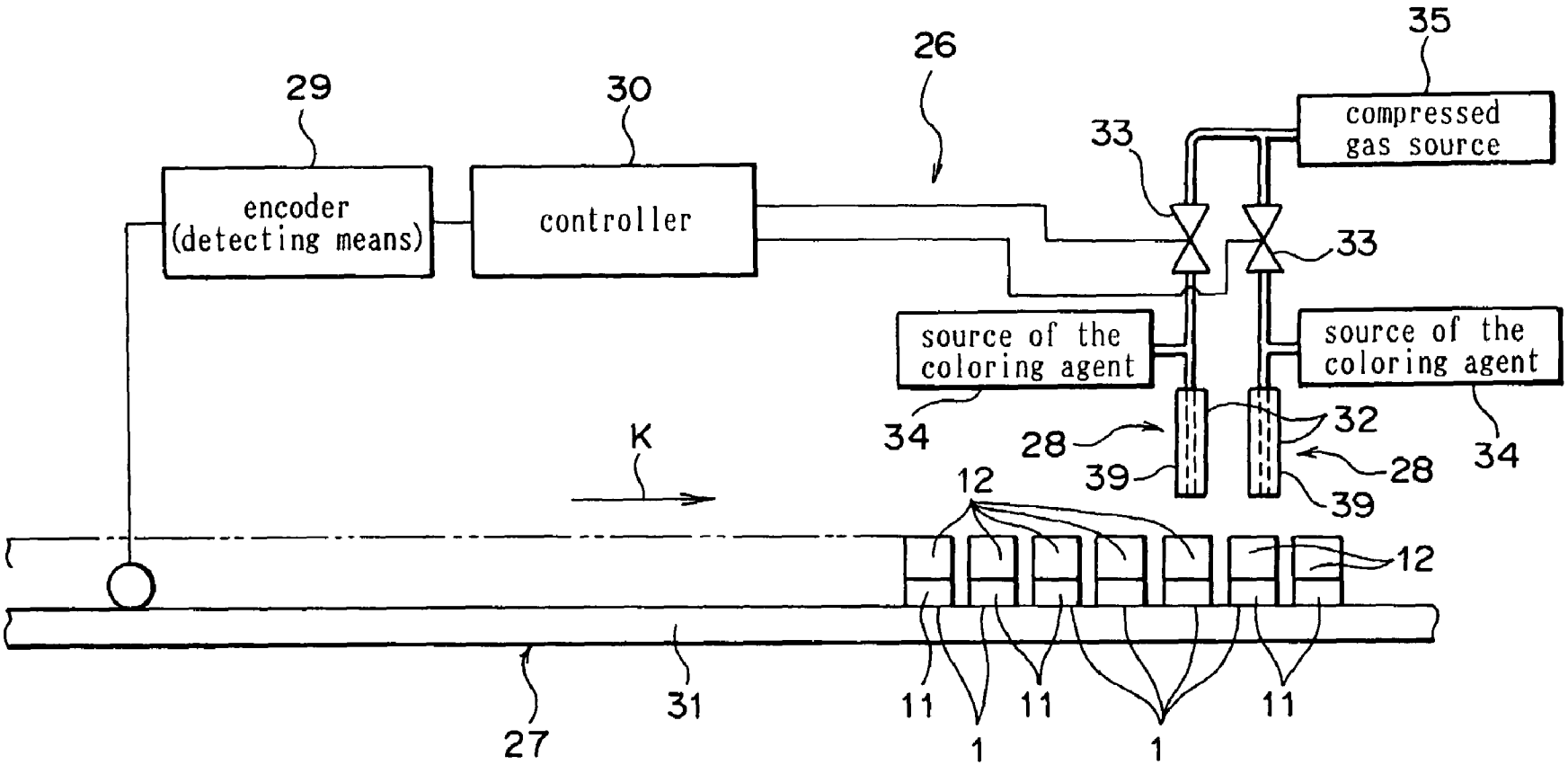
FIG. 5 is an explanation view showing a structure of a marking apparatus for providing a mark on the connector housing of FIG. 1.
Figure 7:
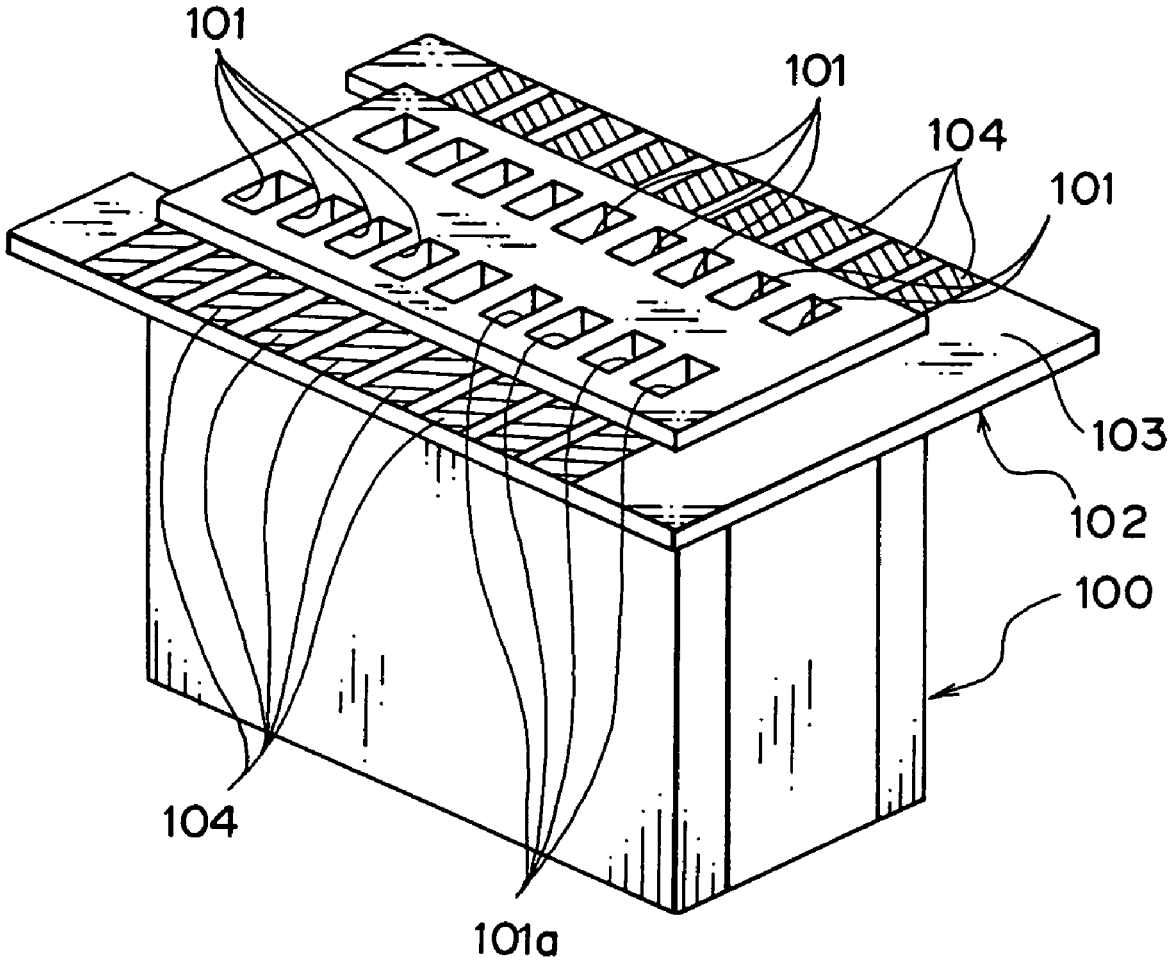
PRIOR ART FIG. 7
FIG. 7 is a perspective view showing a conventional connector housing and an assembling tool and FIG. 8 is an enlarged perspective view showing an example of another embodiment of the present invention.

Further, for forming the mark 21 on the connector housing 1, a marking apparatus 26 is used as shown in FIG. 5. As shown in FIG. 5, the marking apparatus 26 includes a belt conveyor 27, a plurality of coloring units 28, an encoder 29 as a detecting means and a controller 30. The belt conveyor 27 includes a driving pulley (not shown), an idler pulley (not shown) and an endless belt 31 over these pulleys. The endless belt 31 is formed as an endless loop, and when the driving pulley rotates, the endless belt 31 rotates (circulates) around said pulleys.

The endless belt 31 is loaded with the connector housing 1 and carries the connector housing 1 along an arrow K in FIG. 5. In addition, the endless belt 31 is loaded with the connector housings 1 at even intervals. Further, the endless belt 31 is loaded with the connector housing 1 keeping the opening 20*a* of the terminal-receiving chamber 20 of the terminal-receiving portion 12 upward. The belt conveyor 27 having the structure described above loads the endless belt 31 with the connector housing 1, circulates the endless belt 31 around the pulleys, and shifts the connector housing 1 along the arrow K.

For example as shown in FIG. 5, two coloring units 28 are provided. These units are arranged along the arrow K. Each coloring unit 28 includes a nozzle 32, a valve 33 and the like. The nozzle 32 faces the terminal-receiving portion 12 of the connector housing 1 being shifted along the arrow K by the belt conveyor 27. Each nozzle 32 is supplied with the liquid coloring agent of specified color R, G or the like from a source 34 of the coloring agent as shown in FIG. 5. The color of the coloring agent is one of the first color R, the second color G and the like.

The valve 33 is communicated with the nozzle 32. The valve 33 is also communicated with a compressed gas source 35 as shown in FIG. 5. The compressed gas source 35 supplies the nozzle 32 with compressed gas through the valve 33. When opening the valve 33, the coloring agent in the nozzle 32 is jetted (dropped) toward the surface 17*a* of the ceiling wall 17 of the terminal-receiving portion 12 of the connector housing 1 by the compressed gas supplied from the compressed gas source 35.

When closing the valve 33, jetting (dropping) the coloring agent from the nozzle 32 is stopped. According to the structure described above, by opening the valve 33 for a specified time by a signal from such as the controller 30, the coloring units 28 jets (drops) a specified amount of the coloring agent of the specified color R, G or the like toward the surface 17*a* of the ceiling wall 17 of the terminal-receiving portion 12 of the connector housing 1.

The coloring agent described above implies liquid material (industrial organic material) made by dissolving or dispersing coloring material in water or other solvents. There are pigment and dye (most of them are organic material and synthetic compounds) as organic material. Sometimes the dye is used as the pigment and the pigment is used as the dye. For a more concrete example, the coloring agent as defined in this description implies both a coloring liquid and paint.

The coloring liquid implies material made by dissolving or dispersing the dye in a solvent. The paint implies material made by dispersing the pigment in dispersion liquid. Therefore, if the outer surface 1*a* of the connector housing 1 is colored by the coloring liquid, the dye sinks into the connector housing 1. If the outer surface 1*a* of the connector housing 1 is colored by the paint, the pigment does not sink into the connector housing 1, but adheres to the outer surface 1*a* of the connector housing 1.

Namely, the coloring unit 28 partially dyes the outer surface 1*a* of the connector housing 1 with the dye, or partially paints the outer surface 1*a* of the connector housing 1 with the pigment. Thus, the marking apparatus 26 marks the connector housing 1. In summary, coloring the outer surface 1*a* of the connector housing 1 and the sheath part 5 of the electric wire 2 implies both dyeing partially the outer surface 1*a* of the connector housing 1 and the sheath part 5 of the electric wire 2 with the dye and painting partially the outer surface 1*a* of the connector housing 1 and the sheath part 5 of the electric wire 2 with the pigment.

Preferably, the solvent and the dispersion liquid have affinities for synthetic resin forming the connector housing 1 and the sheath part 5 of the electric wire 2. In this case, it means that the dye reliably sinks into the connector housing 1 and the sheath part 5, and the pigment reliably adheres to the outer surface 1*a* of the connector 1 and the outer surface 5*a* of the electric wire 2.

Further, dropping implies that a specified volume of the liquid coloring agent is urged and emitted toward the outer surface 1*a* of the connector housing 1 and the outer surface 5*a* of the electric wire 2 from the nozzle 32 of the coloring units 28 in a droplet, namely, a drop shape. Therefore, in this embodiment, the nozzle 32 of the coloring units 28 urges and emits the specified volume of the liquid coloring agent toward the outer surface 1*a* of the connector housing 1 and the outer surface 5*a* of the electric wire 2 in a drop state.

The encoder 29 measures information about a travel distance and velocity of the endless belt 31 of the belt conveyor 27, namely the connector housing 1, and outputs the information to the controller 30. The controller 30 is a well-known computer equipped with a ROM, a RAM, a CPU and the like, controlling the whole marking apparatus 26 by being connected to the encoder 29, the valve 33 and the like.

The controller 30 memorizes opening-and-closing timing of the valve 33 for forming the mark 21 at a specified position of the surface 17*a* of the ceiling wall 17. The controller 30 memorizes a distance between the nozzles 32 of the coloring units 28. For forming the mark 21 at the specified position of the surface 17*a* of the ceiling wall 17 or the like, the controller 30 jets the coloring agent from the nozzle 32 of the coloring units 28 by opening and closing the valve 33 and the like according to the information of the encoder 29.

When the marking apparatus 26 described above forms the mark 21 on the connector housing 1, namely marks the outer surface 1*a* of the connector housing 1, firstly connector housing 1 is loaded on the endless belt 31 and the belt conveyor 27 is moved. Consequently, the connector housing 1 is shifted along the arrow K.

Next, the controller 30 jets (drops) the specific amount of the liquid coloring agent from the nozzle 32 of each coloring unit 28 toward the specified position such as surface 17*a* of the ceiling wall 17 of the connector housing 1 by controlling such as the valve 33. After depositing of the coloring agent on the specified position of such as the surface 17*a* of the ceiling wall 17 of the connector housing 1, the solvent or the dispersion liquid is evaporated. The mark 21 described above is formed by the dye or the pigment remaining at the specified position of the surface 17*a* and the ceiling wall 17 or the like.

According to this embodiment, the mark 21 indicating the electric wire 2, said electric wire 2 being attached to the male terminal 3 received by the terminal-receiving chamber 20, is provided at each terminal-receiving chamber 20 corresponding to the mark 21. The mark 21 is provided on the surface 17*a* of the ceiling wall 17, said ceiling walls 17 surrounding the opening 20*a* of the terminal-receiving chamber 20. Therefore, since the mark 21 can be easily recognized, the male terminal 3, to which the electric wire 2 indicated by the mark 21 is attached, can be inserted by turns into the terminal-receiving chamber 20.

Moreover, by inserting by turns the male terminal 3, to which the electric wire 2 indicated by the mark 21 is attached, the male terminal 3 is inserted into the terminal-receiving chamber 20 of the connector housing 1. Therefore, the male terminal 3 can be prevented from being inserted into the wrong terminal-receiving chamber 20.

Moreover, the mark 21 is formed on the outer surface la of the connector housing 1. Therefore, the displacement between the mark 21 and the connector housing 1 can be prevented. Therefore, because the male terminal 3 indicated by the mark 21 can be reliably inserted into the terminal-receiving chamber 20, the male terminal 3 can be prevented from being inserted into the wrong terminal-receiving chamber 20. Further, by providing the mark 21, the male terminal 3 to be inserted into the terminal-receiving chamber 20 is indicated. Therefore, after inserting the male terminal 3, by such as comparing the mark 6 with the mark 21, whether the specified male terminal 3 has been inserted into the mating terminal-receiving chamber 20 or not can be confirmed.

The marking apparatus 26 jets (drops) the specified amount of the liquid coloring agent toward the surface 17*a* of the ceiling wall 17 of the connector housing 1. Therefore, a mixture of coloring agents deposited on the connector housing 1 can be prevented. Therefore, the mark 21 can be reliably formed on the surface 17*a* of the ceiling wall 17 surrounding partially the opening 20*a* of the terminal-receiving chamber 20.

Therefore, since the mark 21 can be reliably formed at each terminal-receiving chamber 20 corresponding to said mark 21, the male terminal 3 indicated by the mark 21 can be inserted into the terminal-receiving chamber 20 by turns. Therefore, the connector housing 1, which can prevent the wrong insertion of the male terminal 3 into the terminal-receiving chamber 20, can be obtained.

The mark 21 is formed on the surface 17*a* of the ceiling wall 17 in the embodiment described above, however, the mark 21 can be also formed on any one of the surfaces 16*a*, 18*a*, and 19*a* being flush with the opening 20*a* of the bottom wall 16, the side walls 18, and the partition walls 19 in this invention. Thus, in this invention, the mark 21 can be provided on any one of the surfaces being flush with the opening 20*a* of the walls 16, 17, 18, 19 surrounding the opening 20*a* of the terminal-receiving chamber 20.

Figure 6:
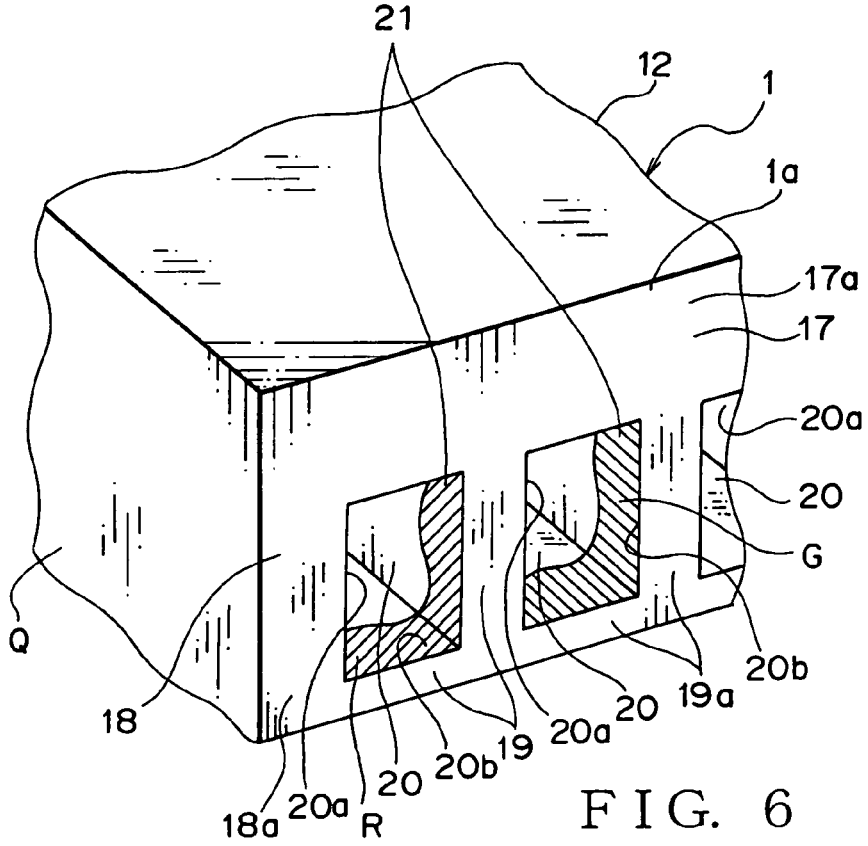
FIG. 6 is an enlarged perspective view showing an example of modifying the substantial part of the connector housing of FIG. 2.

Further, in this invention, as shown in FIG. 6, the mark 21 can be provided at an end 20*b* near the opening 20*a* of the inner surface of the terminal-receiving chamber 20. In this case, the coloring unit 28 of the marking apparatus 26, of course, jets (drops) the specified amount of the liquid coloring agent toward the end 20*b* near the opening 20*a* of the inner surface of the terminal-receiving chamber 20 to form the mark 21. Therefore, the mark 21 is not a round shape.

Further, by coloring the mark 21 in the same color as the mark 6 of the electric wire 2 attached to the male terminal 3, the mark 21 indicates the male terminal 3 to be inserted into the mating terminal-receiving chamber 20. Thus, by inserting by turns the male terminal 3, to which the electric wire 2 having the mark 6 with the same color as the mark 21 is attached, into the terminal-receiving chamber 20, the male terminal 3 is attached to the connector housing 1.

In the case shown in FIG. 6, since the mark 21 is provided at the inner surface of the terminal-receiving chamber 20, a wrong correspondence between the mark 21 and the terminal-receiving chamber 20 can be prevented. Therefore, the male terminal 3 can be by turns inserted into the terminal-receiving chamber 20 corresponding to the mark 21. By inserting the male terminal 3 indicated by the mark 21 into the terminal-receiving chamber 20 corresponding to the mark 21 by turns, the terminal-receiving chamber 20 can be prevented from receiving the wrong male terminal 3. Further, the mark 21 is provided to indicate the male terminal 3 to be inserted into the terminal-receiving chamber 20. Therefore, after inserting the male terminal 3 into the terminal-receiving chamber 20, by such as comparing the mark 6 with the mark 21, whether the specified male terminal 3 has been inserted into the mating terminal-receiving chamber 20 or not can be confirmed.

Moreover, the coloring unit 28 of the marking apparatus 26, of course, jets (drops) the specified amount of the liquid coloring agent toward the end 20*b* near the opening 20*a* of the inner surface of the terminal-receiving chamber 20. Therefore, since the mark 21 can be formed reliably, the terminal-receiving chamber 20 can be prevented from receiving the wrong male terminal 3.

Moreover, in the embodiment described above, the mark 21 is formed on the connector housing 1 using the marking apparatus 26. However, the mark 6 may be formed on the outer surface 5*a* of the electric wire 2 using the marking apparatus 26. Further, in the embodiment described above, the mark 6 and 21 are formed in a round shape. However, the mark 6 and 21 may be formed in a character shape such as a numeral in this invention. Thus, the mark 6 and 21 in this invention imply various figures and characters including numerals.

Further, in the embodiment described above, the mark 6 is formed on the outer surface 5*a* of the electric wire 2. However, the mark 6 may be formed on an outer surface of the male terminal 3 in this invention.

Further, in the embodiment described above, by matching the colors of the mark 6 and the mark 21, the male terminal 3 to be received by the mating terminal-receiving chamber 20 is indicated. However, matching the colors of the mark 6 and the mark 21 is not necessary in this invention. In this case, association of the color of the mark 6 with the color of the mark 21 is defined beforehand, for example, if the mark 6 is black, the male terminal 3 is to be inserted into the terminal-receiving chamber 20 having the red mark 21.

Figure 8:
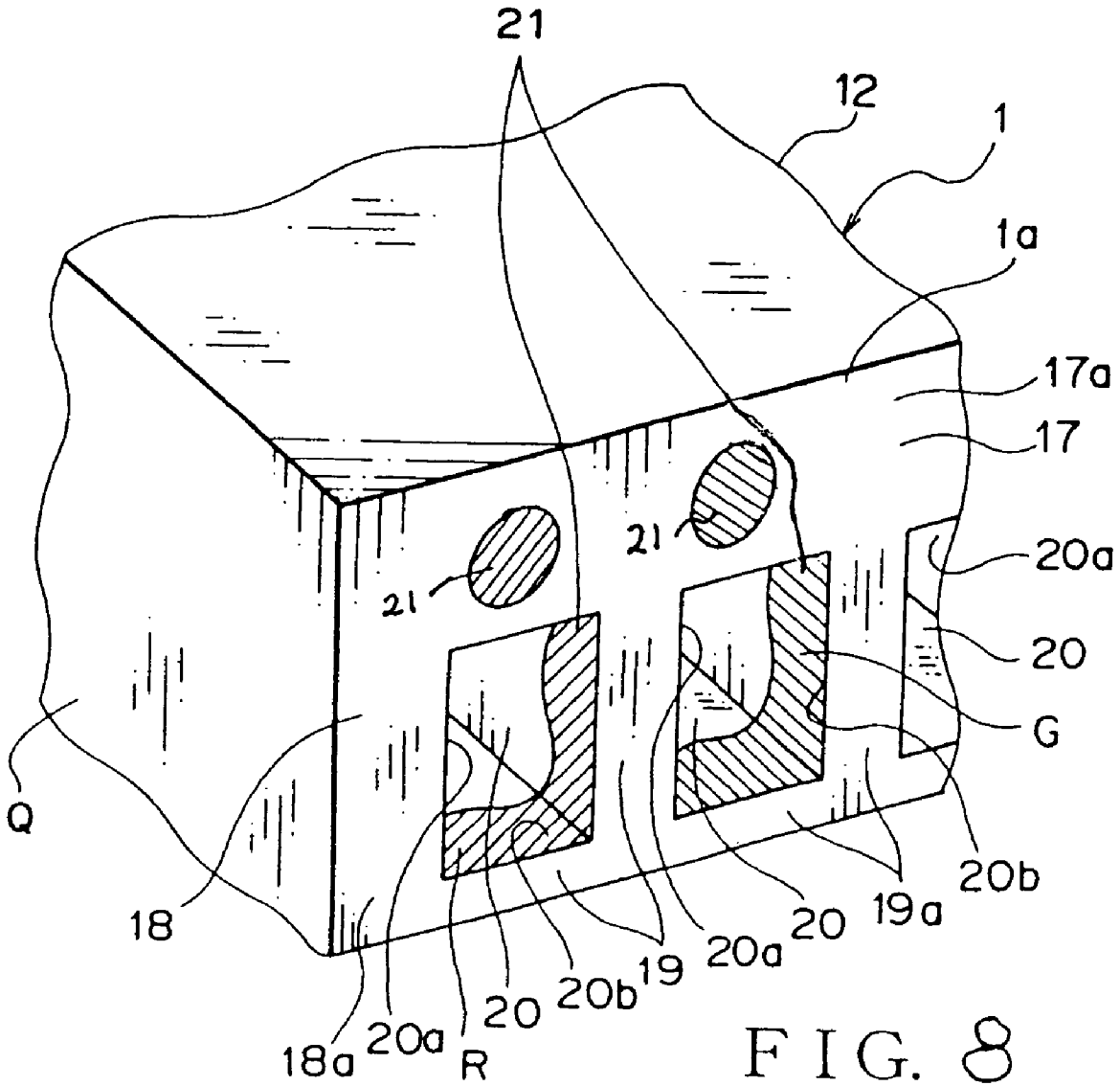

Further, in this embodiment, the mark 21 may be provided on more than one of the surfaces 16*a*, 17*a*, 18*a*, 19*a* being flush with the opening 20*a*. Moreover, as shown in FIG. 8, the mark 21 may be provided on at least one of the surface 16*a*, 17*a*, 18*a*, 19*a*, and the end 20*b* near the opening 20*a* inside the terminal-receiving chamber 20.

In the embodiment described above, the marking apparatus 26 includes two coloring units 28. However, of course, the marking apparatus 26 may include one or more than two coloring units 28.

Further, in the embodiment described above, the controller 30 is the computer equipped with a ROM, a RAM, a CPU and the like. However, the controller 30 may be composed of well-known digital circuits. In this case, preferably, the controller 30 is composed of a counter circuit for counting pulse signals from the encoder 29, a judging circuit for judging what number of pulse signals is inputted to close or open the valve 33, and the like.

Further, in the embodiment described above, the connector housing 1, the electric wire 2, and the like, which compose the wire harness arranged in a vehicle, are described. However, in this invention, the connector housing 1, the electric wire 2 and the like are not limited to use in a vehicle, but are also to use in various electric instruments and electric machines.

Further, in this invention, various means such as dipping, vaporizing, spraying, printing, transfer printing are acceptable for coloring the electric wire 2. In addition, various materials such as acrylic paints, ink (dyes and pigments), UV ink are acceptable for coloring liquid and paints.

INDUSTRIAL APPLICABILITY

As is explained above, in the present invention, a mark for indicating a metal terminal to be received in a mating terminal-receiving chamber is provided at each terminal-receiving chamber corresponding to the mark. Therefore, the metal terminal indicated by the mark can be by turns inserted into the mating terminal-receiving chamber. Accordingly, an insertion of a wrong metal terminal into the terminal-receiving chamber can be prevented. Further, since the mark is formed on an outer surface of a connector housing, a displacement between the connector housing and the mark can be prevented. Therefore, since the metal terminal indicated by the mark is reliably inserted into the terminal-receiving chamber, the insertion of the wrong metal terminal into the terminal-receiving chamber can be prevented. Further, since the mark is formed on the outer surface, whether the specified metal terminal is inserted into the mating terminal-receiving chamber or not can be confirmed with the mark.

According to this invention, the mark is provided at one of the surfaces of the partition walls surrounding the opening of the terminal-receiving chamber. Therefore, the mark can be easily recognized, so that the metal terminal indicated by the mark can be inserted into the mating terminal-receiving chamber by turns. In addition, a displacement between the mark and the connector housing can be prevented. Therefore, a wrong insertion of the metal terminal into the terminal-receiving chamber can be prevented. Further, since the mark can be easily recognized, whether the specified metal terminal is inserted into the mating terminal-receiving chamber or not can be confirmed with the mark.

According to this invention, the mark is provided at an end near the opening of an inner surface of the terminal-receiving chamber. Therefore, the mark can be easily recognized, so that the metal terminal indicated by the mark can be inserted into the mating terminal-receiving chamber by turns. In addition, a displacement between the mark and the connector housing can be prevented, and since the mark is provided at the inner surface, a wrong association of the mark with the terminal-receiving chamber can be prevented. Consequently, a wrong insertion of the metal terminal into the terminal-receiving chamber can be prevented. Further, since the mark can be easily recognized, whether the specified metal terminal is inserted into the mating terminal-receiving chamber or not can be confirmed with the mark.

According to this invention a specified amount of the coloring agent is jetted toward the connector housing. Therefore, a mixture of the coloring agents deposited on the connector housing can be prevented. Accordingly, since each mark corresponding to each terminal-receiving chamber can be formed reliably, the metal terminal indicated by the mark can be inserted into the mating terminal-receiving chamber by turns. Therefore, the terminal-receiving chamber can be prevented from receiving a wrong metal terminal. Accordingly, a connector housing, of which terminal-receiving chamber can be prevented from receiving a wrong metal terminal, can be obtained. Moreover, since each mark corresponding to each terminal-receiving chamber can be formed reliably, whether the specified metal terminal is inserted into the mating terminal-receiving chamber or not can be confirmed with the mark.

According to this invention, a specified amount of the coloring agent is jetted toward the surface of the partition wall of the connector housing. Therefore, the mark can be formed on one of the surfaces of the partition walls surrounding the opening of the terminal-receiving chamber; Accordingly, since the mark can be recognized easily, the metal terminal indicated by the mark can be inserted into the terminal-receiving chamber by turns. Therefore, the terminal-receiving chamber can be prevented from receiving a wrong metal terminal. Consequently, a connector housing, of which terminal-receiving chamber can be prevented from receiving a wrong metal terminal, can be obtained. Further, since the mark can be easily recognized, whether the specified metal terminal is inserted into the mating terminal-receiving chamber or not can be confirmed with the-mark.

According to this invention, a specified amount of the coloring agent is jetted toward the end near the opening of the inner surface of the terminal-receiving chamber. Therefore, the mark can be formed at the end near the opening of the inner surface of the terminal-receiving chamber. Therefore, since the mark can be easily recognized, the metal terminal indicated by the mark can be sequentially inserted into the terminal-receiving chamber.

Further, since the mark is provided on the inner surface, the wrong association of the mark with the terminal-receiving chamber can be prevented, so that the specified metal terminal can be reliably inserted into the mating terminal-receiving chamber. Therefore, the terminal-receiving chamber can be prevented from receiving a wrong metal terminal. Consequently, a connector housing, of which terminal-receiving chamber can be prevented from receiving a wrong metal terminal, can be obtained. Further, since the mark can be easily recognized, whether the specified metal terminal is inserted into the mating terminal-receiving chamber or not can be confirmed with the mark.

According to this invention, a mark for indicating a metal terminal to be received in a mating terminal-receiving chamber is provided at each terminal-receiving chamber corresponding to the mark. Therefore, the metal terminal indicated by the mark can be by turns inserted into the mating terminal-receiving chamber. Accordingly, an insertion of a wrong metal terminal into the terminal-receiving chamber can be prevented.

Further, since the mark is formed on an outer surface of a connector housing, a displacement between the connector housing and the mark can be prevented. Therefore, since the metal terminal indicated by the mark is reliably inserted into(the terminal-receiving chamber, the insertion of the wrong metal terminal into the terminal-receiving chamber can be prevented. Further, since the mark is formed on the outer surface, whether the specified metal terminal is inserted into the mating terminal-receiving chamber or not can be confirmed with the mark.

According to this invention, the mark is provided on one of the surfaces of the partition walls surrounding the opening of the terminal-receiving chamber. Therefore, the mark can be easily recognized, and a displacement between the mark and the connector housing can be prevented. Therefore, since the mark can be recognized easily, by inserting the metal terminal indicated by the mark into the mating terminal-receiving chamber, the terminal-receiving chamber can be prevented from receiving a wrong metal terminal. Further, since the mark formed on the outer surface of the connector housing can be easily recognized, whether the specified metal terminal is inserted into the mating terminal-receiving chamber or not can be confirmed with the mark.

According to this invention, the mark is provided at the end near the opening of an inner surface of the terminal-receiving chamber. Therefore, the mark can be easily recognized, and a displacement between the mark and the connector housing can be prevented. Further, since the mark is provided on the inner surface, the wrong association of the mark with the terminal-receiving chamber can be prevented. Therefore, since the mark can be recognized easily, by inserting the metal terminal indicated by the mark into the mating terminal-receiving chamber, the terminal-receiving chamber can be prevented from receiving a wrong metal terminal. Further, since the mark formed on the outer surface of the connector housing can be easily recognized, whether the specified metal terminal is inserted into the mating terminal-receiving chamber or not can be confirmed with the mark.

The invention claimed is:

1. A connector housing comprising:

a bottom wall, ceiling wall, pair of side walls and a plurality of partition walls which form a plurality of terminal-receiving chambers for receiving a metal terminal, wherein a mark is provided on an outer surface of a said wall of the connector housing corresponding to each terminal-receiving chamber, on a surface of said wall flush with an opening of the terminal-receiving chamber and indicates a specified metal terminal to be received by said corresponding terminal-receiving chamber; and each terminal chamber has an inner surface, and a mark is provided on an end of the inner surface, within the terminal chamber, near the opening of the inner surface of the terminal-receiving chamber.

2. A method of marking a connector housing comprising the steps of:

providing a connector housing having a bottom wall, ceiling wall, pair of side walls and a plurality of partition walls which form a plurality of terminal-receiving chambers for receiving a metal terminal, each of the terminal-receiving chambers having an inner surface;

forming a mark on a surface of a said wall flush with an opening of the terminal-receiving chambers, corresponding to each terminal-receiving chamber for indicating a specified metal terminal to be received by the mating terminal-receiving chamber corresponding to the mark, wherein said step of forming the marks is achieved by jetting a specified volume of coloring agent toward the connector housing to deposit the coloring agent on the connector housing, and forming a mark on the inner surface, within the terminal chamber, near an opening of the inner surface of the terminal-receiving chamber.

3. A method of inserting a metal terminal into a connector housing comprising the steps of:

providing a connecting housing having a bottom wall, ceiling wall, pair of side walls and a plurality of partition walls which form a plurality of terminal-receiving chambers having an inner surface;

marking a plurality of marks, each of which is provided on an outer surface of a said wall of the connector housing at each terminal-receiving chamber, on a surface of said wall flush with an opening of the terminal-receiving chambers and at an end of the inner surface, within the terminal chamber, near the opening of the inner surface of the terminal-receiving chamber, and indicates a specified metal terminal to be received by the mating terminal-receiving chamber corresponding to the marks; and inserting the specified metal terminal to the mating terminal-receiving chamber corresponding to the marks through the opening.

* * * * *